US006431255B1

(12) United States Patent
Ghosh et al.

(10) Patent No.: US 6,431,255 B1
(45) **Date of Patent: *Aug. 13, 2002**

(54) CERAMIC SHELL MOLD PROVIDED WITH REINFORCEMENT, AND RELATED PROCESSES

(75) Inventors: Asish Ghosh, Slingerlands; Robert Arthur Giddings; Frederic Joseph Klug, both of Schenectady; Paul Steven Svec, Scotia, all of NY (US); Philip Harold Monaghan, Hampton, VA (US)

(73) Assignee: General Electric Company, Niskayuna, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/352,112

(22) Filed: Jul. 14, 1999

Related U.S. Application Data

(60) Provisional application No. 60/093,633, filed on Jul. 21, 1998.

(51) Int. Cl.[7] ..... B22C 9/02; B22C 21/14

(52) U.S. Cl. ..... 164/361; 164/411; 164/516

(58) Field of Search ..... 164/36, 516, 519, 164/411, 361

(56) References Cited

U.S. PATENT DOCUMENTS

| | | | | |
|---|---|---|---|---|
| 3,257,692 A | * | 6/1966 | Operhall | 164/361 |
| 3,266,106 A | * | 8/1966 | Lirones | 164/361 |
| 3,654,984 A | * | 4/1972 | Mellen, Jr. et al. | 164/26 |
| 3,955,616 A | | 5/1976 | Gigliotti, Jr. et al. | |
| 3,972,367 A | | 8/1976 | Gigliotti, Jr. et al. | |
| 4,026,344 A | | 5/1977 | Greskovich | |
| 4,031,945 A | | 6/1977 | Gigliotti, Jr. et al. | |
| 4,086,311 A | | 4/1978 | Huseby et al. | |
| 4,097,292 A | | 6/1978 | Huseby et al. | |
| 4,966,225 A | * | 10/1990 | Johnson et al. | 164/519 |
| 4,998,581 A | | 3/1991 | Lane et al. | |
| 5,280,819 A | * | 1/1994 | Newkirk et al. | 164/98 |
| 5,667,742 A | * | 9/1997 | Dwivedi et al. | 264/658 |

FOREIGN PATENT DOCUMENTS

| | | | |
|---|---|---|---|
| DE | 32 26 114 A | * | 2/1983 |
| EP | 903189 A1 | | 3/1999 |
| GB | 1410634 | * | 10/1973 |
| JP | 55064945 | * | 5/1980 |
| JP | 006277794 A | * | 4/1994 |

OTHER PUBLICATIONS

"Ceramic Oxide Fibers: Building Blocks for New Applications", by T. L. Tompkins, Rejprinted from Ceramic Industry, Apr. 1995, Business News Publishing Company, pp. 5–8.

* cited by examiner

*Primary Examiner*—M. Alexandra Elve
*Assistant Examiner*—Len Tran
(74) *Attorney, Agent, or Firm*—Robert P. Santandrea; Noreen C. Johnson

(57) ABSTRACT

A ceramic casting shell mold having a pre-selected shape is described. It includes alternate, repeating layers of a ceramic coating material and a ceramic stucco, defining a total thickness of the shell mold; and a ceramic-based mat of reinforcing material disposed in the alternate, repeating layers of coating material and stucco. The reinforcing material for the mat is usually made from a ceramic material, and includes fibers having a bi-directional orientation. A method for making a ceramic casting shell mold is also described, as well as articles cast from such a mold, e.g., superalloy articles.

19 Claims, No Drawings

CERAMIC SHELL MOLD PROVIDED WITH REINFORCEMENT, AND RELATED PROCESSES

CROSS-REFERENCE TO RELATED APPLICATIONS

This application is related to Provisional Application No. 60/093,633 filed on Jul. 21, 1998.

BACKGROUND OF THE INVENTION

This invention relates generally to metal casting. More specifically, it relates to shell molds used in the casting of metal components, e.g., components made from superalloys.

The casting of metals is carried out by various techniques, such as investment casting. Ceramic shell molds are used during investment-casting, to contain and shape the metal in its molten state. The strength and integrity of the mold are very important factors in ensuring that the metal part has the proper dimensions. These shell mold characteristics are especially critical for manufacturing high performance components, such as superalloy parts used in the aerospace industry.

Investment casting techniques often require very high temperatures, e.g., in the range of about 1450° C. to 1750° C. Many conventional shell molds do not exhibit sufficient strength at those temperatures. The molds become susceptible to bulging and cracking when they are filled with the molten metal. (Bulging can also occur when very large parts are being cast—even at lower temperatures). Bulging can alter the dimensions of the mold, thereby causing undesirable variation in the component being cast. Cracking could result in failure of the mold as the molten material runs out of it.

Clearly, greater strength and dimensional stability are required for shell molds used at very high casting temperatures, or for those used to cast very large parts. The problem is addressed by J. Lane et al in U.S. Pat. No. 4,998,581. In that disclosure, shell molds are strengthened by wrapping a fibrous reinforcing material around the shell mold as it is being made. In preferred embodiments, the reinforcing material is said to be an alumina-based or mullite-based ceramic composition having a specific, minimum tensile strength. The reinforcing material is apparently wrapped in spiral fashion around the shell mold with a tension sufficient to keep it in place as ceramic layers are applied to the mold to build it up to its desired thickness.

The Lane patent appears to provide answers to some of the problems described above. However, there appear to be some considerable disadvantages in practicing the invention disclosed in that patent. For example, mullite-based materials are difficult to produce without second phase inclusions of either silica- or alumina-containing compounds. These inclusions can degrade the physical properties of the mold. In addition, many of the reinforcing materials employed in U.S. Pat. No. 4,998,581 have thermal expansions much less than the mold. These large thermal expansion differences will make fabrication of a crack-free mold more difficult.

It should thus be apparent that further improvements in the properties of shell molds used under the conditions described above would be welcome in the art. The shell molds should have the strength to withstand high metal-casting temperatures, and should be suitable for casting large parts. The molds should also be dimensionally stable at elevated temperatures, and throughout various heating/cooling cycles. Moreover, if the molds are to be improved by the use of reinforcing materials, such materials should be flexible enough, before being fired, to satisfy the shape requirements for the mold, especially when intricate metal components are being cast. Finally, the preparation of improved shell molds should be economically feasible, e.g., not requiring the use of a significant amount of additional equipment. The use of the new molds should not result in undesirable increases in the cost for manufacturing metal parts in the investment casting process.

SUMMARY OF THE INVENTION

The desired improvements discussed above have been obtained by way of the discoveries upon which the present invention is based. In one aspect, the invention is a ceramic casting shell mold having a pre-selected shape, and comprising repeating layers of a ceramic material which define the thickness and shape of the mold, and a ceramic-based mat disposed in the layers of ceramic material. The mat substantially conforms to the shape of the mold, providing the mold with structural reinforcement. In many embodiments, the casting shell comprises:

(a) alternate, repeating layers of a ceramic coating material and a ceramic stucco, defining a total thickness of the shell mold; and (b) a ceramic-based mat of reinforcing material disposed in the alternate, repeating layers of coating material and stucco at an intermediate thickness.

The reinforcing material for the mat is usually a silicon carbide-based material, or an alumina- or aluminate-based material. Mixtures of any of these materials can also be used. In preferred embodiments, the reinforcement mat comprises fibers having a bi-directional orientation. Moreover, the mat is preferably placed within about 10% to about 40% of the thickness from the inner wall of the mold, or within about 10% to about 25% of the thickness from the outer wall of the mold.

Furthermore, openings within the surface of the mat are large enough to allow the passage of ceramic particles when the mat is prepared from the coating material and the stucco. Moreover, in preferred embodiments, the coefficient of thermal expansion (CTE) of the mat is within about 50% of the CTE of the shell mold layers in which it will be inserted.

A method for making a ceramic casting shell mold is also described, comprising the steps of:

(I) applying a ceramic-based reinforcement mat to a ceramic layer-surface of a partial shell mold, e.g., one being made by an investment casting process;

(II) completing the shell mold by applying additional ceramic layers over the reinforcement mat; and then (III) firing the shell mold at an elevated temperature.

Shell molds prepared by the method of the present invention exhibit substantial improvements in strength and dimensional stability at high temperatures, as compared to many of the shell molds of the prior art. Many metals or metal alloys can efficiently be cast in such shell molds, such as nickel-based superalloys.

DETAILED DESCRIPTION OF THE INVENTION

The ceramic shell molds which are reinforced according to the present invention are known in the art. Moreover, information related to shell molds for investment casting is widely available. Exemplary sources of useful information are as follows: *Kirk-Othmer Encyclopedia of Chemical Technology,* 3rd Edition, Vol. 7, p. 798 et seq.; *Modern*

*Metalworking*, by J. R. Walker, The Goodheart-Willcox Co., Inc., 1965; *Shell Molding and Shell Mold Castings*, by T. C. Du Mond, Reinhold Publishing Corp., 1954; and *Casting and Forming Processes in Manufacturing*, by J. S. Campbell, Jr., McGraw-Hill Book Company, Inc., 1950.

Shell molds are usually composed of refractory particles (e.g., refractory oxide particles) bonded together by a silica or phosphate gel. Examples of the typical refractory particles are alumina-based materials, aluminate-based materials (such as yttrium aluminate), or mixtures of these materials. Various patents describe many aspects of conventional shell-molding processes. The following are exemplary, and are all incorporated herein by reference: U.S. Pat. No. 4,998,581 (Lane et al); U.S. Pat. No. 4,097,292 (Huseby et al); U.S. Pat. No. 4,086,311 Huseby et al); U.S. Pat. No. 4,031,945 (Gigliotti, Jr. et al); U.S. Pat. No. 4,026,344 (Greskovich); U.S. Pat. No. 3,972,367 (Gigliotti, Jr. et al); and U.S. Pat. No. 3,955,616 (Gigliotti, Jr. et al).

One investment casting technique which is especially suitable for the present invention is the "lost wax" process. In one version of this technique, a wax pattern (i.e., a replica of the part being cast) is immersed repeatedly in a liquid slurry of refractory oxide particles in a silica- or phosphate-bearing binder. Usually, the slurry is highly loaded with the ceramic solids, e.g., at least about 40 volume percent, with the remainder being deionized water, an organic solvent, or a mixture thereof. Sufficient time is provided between immersions to allow the slurry coat to partially or completely dry on the wax. After a sufficient thickness of ceramic has built up on the wax, the wax is removed by various techniques, as discussed below. The completed mold is then fired, providing it with enough strength to withstand the casting process.

In some preferred embodiments of this invention, the wax pattern is first dipped into the slurry, and then the excess material is allowed to drain from the pattern. Immediately after the wax pattern is wetted, but before it dries, the pattern is "rained" upon with additional ceramic materials, e.g., ceramic oxides. This deposition is often carried out in a standard fluidized bed chamber, and the applied layer is sometimes referred to as a "ceramic stucco". The sequence of dipping and raining ceramic materials on the pattern is repeated until the desired thickness has been achieved. The other steps are conventional, e.g., wax removal and firing.

An important feature of the present invention is the presence of at least one ceramic-based mat situated within the shell mold, i.e., within the wall of the shell mold. The mat can be made from a variety of materials. Non-limiting examples include alumina-based materials, aluminate-based materials, silicon carbide-based materials, and mixtures of any of these materials. As used herein, the term "based" refers to the presence of the relevant material at a level of greater than about 50% by weight. Thus, these materials often contain other constituents as well, e.g., other ceramic oxides such as silicon dioxide, boric oxide, and the like.

The composition of the reinforcement mat is determined in part by the coefficient of thermal expansion (CTE) of the materials used to make the mat. At use temperatures in the range of about 1500° C. to about 1750° C., the mat material (when inserted into the shell mold layers and bonded thereto, as discussed below) should typically exhibit a CTE which is within about 50% of the CTE of the shell mold layers in which it will be inserted. In preferred embodiments, the CTE is within about 30% of the CTE of the shell mold layers.

The mat is usually made from ceramic fibers of the materials described above. In some instances, the fibers are prepared by twisting together a number of strands of the ceramic materials. (For the purpose of this disclosure, "strands" are the lengths of materials that are used to form a single "fiber".) Commercial examples of strands which can be used to form the mats are the Nextel® materials, e.g., Nextel® 440 (70% aluminum oxide, 28% silicon dioxide, 2% boric oxide, by weight), Nextel® 550 (73% aluminum oxide and 27% silicon dioxide, by weight); Nextel® 610 (greater than 99% aluminum oxide, 0.2–0.3% silicon dioxide, 0.4–0.7 iron oxide, by weight), and Nextel® 720 (85% aluminum oxide and 15% silicon dioxide, by weight). These materials are available from 3M Company, and have a diameter of about 10–12 microns. They are described, for example, in *Ceramic Oxide Fibers: Building Blocks for New Applications*, by T. L. Tompkins, reprint from *Ceramic Industry*, April 1995, which is incorporated herein by reference.

The fibers usually have a diameter in the range of about microns to about 2000 microns. In preferred embodiments, the diameter is in the range of about 250 microns to about 1000 microns. Thus, as an example, about 25 strands of one of the Nextel materials can be twisted together to form a fiber of the desired diameter. (It should be understood that strands having smaller or larger diameters than the Nextel materials could be employed.) While the fibers could be twisted manually, mechanical techniques for twisting the strands to form the fiber are well-known in various fields related to textiles and cordage, e.g., as described in the *Encyclopedia Americana*, Americana Corporation, Vol. 7, pp. 681–685b (1964), which is incorporated herein by reference.

The fibers which are used for the mat have a bi-directional orientation. In other words, fibers are generally situated cross-wise to each other. They are also usually interwoven. Woven fabrics are often described in terms of their warp (vertical fibers) and their weft (horizontal fibers). In the present instance, the vertical and horizontal fibers are usually oriented at about 90° relative to each other, since manufacturing processes usually provide such an orientation. However, the degree of orientation can vary somewhat.

The mat can be made by weaving the fibers, using machinery well-known in the textile arts. Information regarding weaving, textile machinery, and woven fabrics can be found, for example, in the *Encyclopedia Americana*, Americana Corporation, Vol. 26, pp. 467b–481 (1964); and Vol. 29, pp. 651–652 (1964), both texts being incorporated herein by reference. Manual weaving of the fibers is also possible. The mat usually has a thickness of about 25 microns to about 2000 microns, and preferably, in the range of about 250 microns to about 1000 microns.

The present inventors discovered that a mat formed from ceramic fibers with a bi-directional orientation provides significantly greater strength to the shell mold, as compared to other types of fibrous reinforcement. As an example, the mold was found to be stronger than a shell mold prepared according to the teachings of U.S. Pat. No. 4,998,581 (J. Lane et al). The Lane patent describes the use of a continuous fiber wrapped around a portion of a shell mold in a single direction.

As mentioned above, the fibers in the mat are usually arranged in the form of a warp and a weft. Usually, the warp and the weft are formed, independently, by fibers which are positioned (usually parallel to each other) at a frequency in the range of about 5 fibers per meter to about 100 fibers per meter. In some preferred embodiments, the frequency is in the range of about 10 fibers per meter to about 50 fibers per meter.

One factor in determining the character of the warp and the weft involves the openings between the intersecting fibers. These openings should be large enough to allow the passage of the refractory particles present in the slurry during preparation of the shell mold. In the case of alumina, the slurry particles are usually disc-shaped (i.e., tabular alumina) or sphere-shaped, and have an average diameter in the range of about 40 microns to about 75 microns. Particles made from other ceramic materials may have different shapes, but will usually have approximately the same diameter as the alumina particles. The average area of the openings between the warp and weft is usually at least about $10^8$ square microns, and preferably, at least about $4\times10^{10}$ square microns.

Any investment casting technique may be used for the present invention. In preferred embodiments, the "lost wax" process is carried out in some form. The ceramic materials used in the preparation of shell molds are often similar or identical to those described for preparing the reinforcement mat. Alumina-based materials, aluminate-based materials (such as yttrium aluminate), or mixtures of any of these materials, are often preferred. A slurry is prepared from the ceramic material and a suitable binder, such as silica or colloidal silica. The slurry may further include wetting agents, defoaming agents, or other appropriate additives, some of which are described in the Greskovich patent referenced previously, U.S. Pat. No. 4,026,344. Those of ordinary skill in the art are familiar with the conventional parameters which require attention when forming slurries of this type. Illustrative parameters include mixing speeds and viscosity, as well as the temperature and humidity of the mixture and of the ambient environment.

As mentioned previously, construction of the shell mold is usually carried out by applying a layer of the slurry to the wax pattern, followed by applying a layer of a stucco aggregate (e.g., made from commercially-available fused alumina) to the slurry layer, and then repeating the process a number of times. (The initial sequence of layers are those which will ultimately be closest to the mold cavity). A typical chemical composition for a suitable slurry coat, after drying (and ignoring the stucco composition), includes about 80% to about 100% by weight of the alumina-based material, and about 20% to about 0% by weight of the binder material. Small amounts of other components are sometimes present, such as zircon.

The number of times the layer-sequence is repeated will of course depend on the desired thickness of the mold. Usually, about 4 to about 20 total ceramic slurry layer/stucco layer pairs are used for the shell mold. For some end uses, about 10 to about 18 layer pairs are applied. At one or more stages within the sequence of applying slurry and stucco aggregate layers, the layer-application is temporarily stopped, and the reinforcement mat is incorporated into the partial shell mold, as described below.

As a more specific illustration, a wax pattern of a metal component (such as a turbine blade or nozzle) can be immersed in the slurry, and then withdrawn and drained, as taught in U.S. Pat. No. 4,026,344. The wet surface of the slurry-coated pattern can then be sprinkled with the stucco aggregate in a fluidized bed, and then air-dried. The process is then repeated as many times as is necessary to produce a desired thickness of successive slurry-ceramic layers with a stucco layer in between mutually adjacent layers.

Usually, the ceramic particles in the first ceramic slurry layer/stucco layer pair, and possibly the second layer pair, have a size less than the particles in successive layers. As an example, the average ceramic particle size of stucco in the first pair of layers is preferably less than about 200 microns. The average particle size of stucco in successive layers is usually in the range of about 200 microns to about 800 microns. The larger particle size in the successive layers permits mold thickness to be increased rapidly. Larger particle sizes are also sometimes used to control the shrinkage of the mold.

Particles from the slurry layers and/or stucco layers adjacent to the reinforcement mat tend to flow through the openings in the mat, as additional layers of slurry and stucco are applied to complete the mold. This movement of particles through the openings is important for some embodiments of the present invention, because it provides further strength and stiffness to the mat when the completed shell mold is fired.

As mentioned previously, the ceramic-based reinforcement mat is usually incorporated into the partially-formed shell mold (i.e., its wall) at a pre-selected, intermediate thickness. The exact "depth" of the mat within the mold is dependent on various factors, such as mat thickness, the composition of the mold layers, the types of fibers used to form the mat, and the shape of the mold. For simplicity herein, the mold will be considered to have an "inner wall" which forms the cavity into which molten metal is poured to produce a shaped casting. The "outer wall" is opposite the inner wall, i.e., it is the wall farthest away from the cavity.

It is often preferable to place the reinforcement mat at a position off-center of the wall-thickness of the mold, since the present inventors have discovered that such a position appears to result in enhanced mold strength. In especially preferred embodiments, the mat is placed at a wall thickness as close as possible to the inner wall of the mold, without adversely affecting the cavity surface (e.g., without causing surface roughness). For example, the mat is preferably placed within about 10% to about 40% of the thickness from the inner wall of the mold, and most preferably, within about 10% to about 25% of the thickness from the inner wall of the mold. In other preferred embodiments, the mat is placed at a thickness as close as possible to the outer wall of the mold, e.g., within about 10% to about 25% of the thickness from the outer wall. (Placement of the mat too close to the outer wall may not provide the desired strength to the interior regions of the mold). In determining the most appropriate position for the mat, those skilled in the art can vary its position and then evaluate the resulting physical properties of the mold, based on the teachings herein.

More than one reinforcement mat could be used in the shell mold. As an example, a first mat could be disposed within about 10% to about 40% of the inner wall of the mold, and a second mat could be disposed within about 10% to about 25% of the outer wall. Two mats can be used in situations where a very high degree of mold strength is required.

A face of the reinforcement mat is applied against the substantially-parallel face of the outermost layer of the partial shell mold. Usually, there is some natural adherence which keeps the mat in place while subsequent slurry/stucco layers are applied; or the mat can be kept in place in the same manner that the other layers are usually kept in place during the mold-building process. After insertion of the reinforcement mat, the deposition of subsequent ceramic slurry/stucco aggregate layers can be continued as before, until the appropriate mold thickness is obtained. Usually, the mold, once fired, has a total wall thickness (i.e., from the inner wall to the outer wall) in the range of about 0.50 cm to about 2.50 cm, and preferably, about 0.50 cm to about 1.25 cm.

In some instances, cores are incorporated into shell molds being fabricated according to the present invention. The cores are often used to provide holes or cavities within the mold, and they may be formed by using inserts of vitreous silica, alumina, aluminates, or any combination of such materials, for example. The core material is removed from the final casting by conventional techniques. Many references describe the use of cores, e.g., *Modern Metalworking; Casting and Forming Processes in Manufacturing*; and U.S. Pat. Nos. 4,097,292, and 4,086,311, all mentioned above. The reinforcement mat of this invention assists in maintaining the proper metal thickness around cores within the mold—especially when the mold would normally be susceptible to creep and distortion at high temperature. Precise control over the size of cavities within the mold is often critical when forming metal parts which have intricate shapes, and/or which have very rigorous dimensional requirements.

After the shell mold has been completed, the wax is removed by any conventional technique. For example, flash-dewaxing can be carried out by plunging the mold into a steam autoclave, operating at a temperature of about 100° C.–200° C. under steam pressure (about 90–120 psi), for about 10–20 minutes. The mold is then usually pre-fired. A typical pre-firing procedure involves heating the mold at about 950° C. to about 1150° C., for about 60 minutes to about 120 minutes.

The shell mold can then be fired according to conventional techniques. The required regimen of temperature and time for the firing stage will of course depend on factors such as wall thickness, mold composition, and the like. Typically, firing is carried out at a temperature in the range of about 1350° C. to about 1750° C., for about 5 minutes to about 60 minutes. As the mold is fired, the fibers in the reinforcement mat (or mats) react with the ceramic material in the shell mold. This reaction bonds the fibers to the shell mold, providing greater strength and creep resistance to the mold.

Metal can immediately be poured into the mold at this time, to carry out a desired casting operation. Alternatively, the mold can be allowed to cool to room temperature. Further steps which are conventional to mold fabrication may also be undertaken. These steps are well-known in the field of shell molds. Examples include techniques for repairing and smoothing the surfaces of the mold.

It should be apparent from this discussion that another embodiment of this invention is directed to a method for making a ceramic casting shell mold, comprising the following general steps:

(I) applying a ceramic-based reinforcement mat to a ceramic layer-surface of a partial shell mold formed by applying successive ceramic layers over one another;

(II) completing the shell mold by applying additional ceramic layers over the reinforcement mat; and then (III) firing the shell mold at an elevated temperature.

Various other details regarding the processes of the present invention are provided herein, e.g., in the following examples.

Shell molds like those of the present invention are used for casting a wide variety of metals or metal alloys, such as titanium and nickel-based superalloys. Thus, components made from such materials with the reinforced shell mold are also within the scope of this invention.

The following examples are merely illustrative, and should not be construed to be any sort of limitation on the scope of the claimed invention.

EXAMPLE 1

Sample molds were prepared, using conventional shell mold technology. The steps were as follows (with mold reinforcement being carried out within the sequence of steps, as described below):

(1) A wax pattern is dipped into a slurry of −325 mesh tabular alumina and silica binder;

(2) The coated pattern is drained;

(3) The coated pattern is then placed in a rain machine with 80-grit fused alumina, for about 15–20 seconds;

(4) The pattern is air-dried;

(5) Steps 1–4 are repeated;

(6) The pattern is dipped in a suspension of −240 mesh and −325 mesh alumina, with a silica binder;

(7) The pattern is dipped in a fluidized bed of −54 mesh alumina;

(8) The pattern is then air-dried; and (9) Steps 6–8 are repeated 8 times.

For the purpose of this description, the "primary coat" is defined as the first two layers applied in steps 1–4, while the "secondary coats" are defined as the layers applied in steps 6–9. Rectangular wax patterns were used to prepare the molds. After fabrication, two opposing walls of the mold were scraped away to leave two flat bars. The bars (20.32 cm long and 2.54 cm wide) were then fired at 1000 ° C. in air, to develop additional handling strength. The molds were then fired at about 1550° C., prior to evaluation. The bars were uncracked after being fired.

The mat was made by first twisting together a number of strands of Nextel® 440 material, to form fibers for the warp and the weft. The fibers had an average diameter of about 1000 microns. The fibers were then manually woven in a substantially square pattern, with parallel fibers being spaced about 10 mm from each other. This provided openings in the mat of about 10,000 microns by about 10,000 microns.

For the sample based on the present invention, the mat was inserted into the partial shell mold, between applications of the 3rd and 4th secondary coats. This position represented the completion of about 30% of the shell mold. (It should be noted that the midpoint of individual layers of ceramic coating and ceramic stucco does not always correspond to the center of the wall thickness of the mold. This is due in part to variation in the thickness of the individual layers, e.g., because of variations in ceramic particle size, as discussed above.)

Three sets of samples were prepared for testing. (Each set usually included about 3 samples, and the results were provided as a range of values). Set 1 was a comparative shell mold prepared as described above, with no reinforcement of the mold. The shell molds of set 2 were prepared in the same manner, but with unidirectional reinforcement. This reinforcement was achieved by winding a ceramic fiber (the same type used for the mat described above in this example) after the mold was about 30% complete. Winding of the fiber as the mold was built up was carried out in a manner similar to that set forth in the Lane patent, U.S. Pat. No. 4,998,581. The average distance between the windings was about 10 mm. Set 3 was based on the present invention, and included the mat described above, for bi-directional reinforcement.

For testing purposes, bars were machined from the molds described in the table, after the molds had been sintered. Only the exterior of the mold was machined, to provide a thickness of 0.79 cm. The width of the bars after machining was 2.3 cm. The primary coats were left intact during the machining operation.

A 3-point modulus-of-rupture test on a 4 cm span was performed on each bar at 1550° C. For this test, each sample was loaded until it fractured into two pieces. The strength (in megapascals) of each bar after testing is shown in the table:

TABLE 1

Comparison of Shell Mold Strength

| Set No. | Type of Reinforcement | Strength (MPa)* |
|---|---|---|
| 1** | No Reinforcement | 17.7–19.5 |
| 2** | Unidirectional | 18.3–18.5 |
| 3*** | Bi-directional | 21.6–22.2 |

*Strength at 1550° C., expressed in megapascals. Sinter temperature for each sample was 1550° C.
**Comparative samples.
***Samples of present invention, with "cross-ply" reinforcement.

It can readily be seen from the data that at high temperatures, there is a substantial improvement in strength for shell molds reinforced according to the present invention.

Moreover, the shell molds of the present invention appeared to exhibit substantially less dimensional change at 1550° C., as compared to shell molds which did not contain any reinforcement.

EXAMPLE 2

Two sets of test bars were prepared for comparative testing: set A outside the scope of the present invention, and set B within the scope of the present invention. Each test bar was 6 inches (15.2 cm) in length; 0.75 inch (1.91 cm) in width, and 0.25 inch (0.64 cm) in thickness. The set A bars were prepared as in Example 1, without using any type of reinforcement mat. The set B bars included a hand-made web of ceramic fibers, prepared from twisted strands of Nextel® 440 material, applied to a partial shell mold. The web was prepared by interweaving spaced horizontal fibers (1 cm apart from each other) with spaced vertical fibers (also 1 cm apart). The shell mold for the set B samples was then completed by the use of the secondary coats of slurry and binder, as in Example 1, so that the web was positioned within about 30% of the inner wall of the mold. After the shell molds were sintered, the test bars were machined to the dimensions set forth above.

Each sample was individually placed across a span, i.e., a "sag fixture", in which the two supports were 1.5 inches (3.8 cm) high, and 4.5 inches (11.4 cm) from each other. This structure permitted the center of the sample to move without restriction if it were to sag. Each sample was then heated to 1600° C. and held at that temperature for 1 hour, followed by furnace-cooling. The samples from set A (without any reinforcement ) sagged to a greater extent than the samples of set B.

The results of these sag tests demonstrate that reinforcement of the shell mold according to this invention results in greater sag-resistance at high temperatures. The modulus-of-rupture tests described in Example 1 further demonstrate greater strength for the reinforced mold. These properties will result in less distortion of the mold when it is being heated prior to metal casting, and when it is slowly cooled, after pouring (but prior to solidification).

While preferred embodiments have been set forth for the purpose of illustration, the foregoing description should not be deemed to be a limitation on the scope of the invention. Accordingly, various modifications, adaptations, and alternatives may occur to one skilled in the art without departing from the spirit and scope of the present disclosure.

All of the patents, articles, and texts mentioned above are incorporated herein by reference.

What is claimed:

1. A ceramic casting shell mold having a pre-selected shape, and comprising:

(a) alternate, repeating layers of a ceramic coating material and a ceramic stucco, defining a total thickness of the shell mold and a mold cavity therein; and (b) a ceramic-based mat of reinforcing material disposed in the alternate, repeating layers of coating material and stucco at an intermediate thickness, wherein the ceramic-based mat comprises a plurality of interwoven fibers having a bi-directional patterned orientation in which the plurality of interwoven fibers are positioned with respect to each other in a frequency in the range of about 5 fibers to about 100 fibers per meter.

2. The shell mold of claim 1, wherein the reinforcing material is selected from the group consisting of alumina-based materials, aluminate-based materials, silicon carbide-based materials, and mixtures of any of the foregoing materials.

3. The shell mold of claim 1, wherein the fibers in the mat are arranged in the form of a warp and a weft, and wherein the mat comprises openings between the fibers in the warp and the weft.

4. The shell mold of claim 3, herein the warp and the weft each independently contain about 5 fibers to about 100 fibers per meter.

5. The shell mold of claim 4, wherein the warp and the weft each independently contain about 10 fibers to about 50 fibers per meter.

6. The shell mold of claim 3, wherein each of the openings has an area of at least about $10^8$ square microns.

7. The shell mold of claim 6, wherein the ceramic particles comprise alumina.

8. The shell mold of claim 1, wherein the coefficient of thermal expansion (CTE) of the mat is within about 50% of the CTE of the shell mold layers in which it will be inserted.

9. The shell mold of claim 1, comprising an inner wall adjacent to the mold cavity, and an outer wall opposite the inner wall, said walls being separated by the total thickness of the shell mold, wherein the mat is positioned within about 10% to about 40% of the thickness from the inner wall.

10. The shell mold of claim 1, comprising an inner wall adjacent to the mold cavity, and an outer wall opposite the inner wall, said walls being separated by the total thickness of the shell mold, wherein the mat is positioned within about 10% to about 25% of the thickness from the outer wall.

11. The shell mold of claim 1, wherein the shell mold comprises at least two of the ceramic-based mats, wherein each mat is disposed in a different set of the alternate, repeating layers of coating material and stucco.

12. The shell mold of claim 1, wherein the ceramic-based mat has a thickness of about 25 microns to about 200 microns.

13. The shell mold of claim 1, wherein the alternate, repeating layers of ceramic coating material and ceramic stucco comprise a first layer of coating material and stucco, and then successive layers of coating material and stucco, and wherein the average size of ceramic particles within the first layer of ceramic stucco is less than about 200 microns.

14. A ceramic casting shell mold having a pre-selected shape, comprising repeating layers of a ceramic material which define the thickness and shape of the mold and a mold cavity therein, and a ceramic-based mat disposed in the layers of ceramic material, wherein the ceramic-based mat conforms to the shape of the mold and providing structural reinforcement thereto, and wherein the ceramic-based mat comprises a plurality of interwoven fibers having a bi-directional patterned orientation in which the plurality of interwoven fibers are positioned with respect to each other in a frequency in the range of about 5 fibers to about 100 fibers per meter.

15. The shell mold of claim 14, wherein the ceramic material of the repeating layers and of the mat comprises alumina.

16. The shell mold of claim 14, wherein the ceramic-based mat is disposed at a position off-center of a wall-thickness of the mold.

17. The shell mold of claim 14, wherein the shell mold has a total wall thickness in the range of about 0.50 cm to about 2.50 cm.

18. The shell mold of claim 6, wherein each of the openings has an area of at least about $4\times10^{10}$ square microns.

19. The shell mold of claim 6, wherein the warp and the weft are oriented at an angle of about 90° with respect to each other.

* * * * *